US010464783B2

(12) United States Patent
Depot

(10) Patent No.: US 10,464,783 B2
(45) Date of Patent: Nov. 5, 2019

(54) ELEVATOR SHAFT ACCESS SAFETY DEVICE AND METHOD OF USING THE SAME

(71) Applicant: Germain Depot, St-Denis de Brompton (CA)

(72) Inventor: Germain Depot, St-Denis de Brompton (CA)

( * ) Notice: Subject to any disclaimer, the term of this patent is extended or adjusted under 35 U.S.C. 154(b) by 0 days.

(21) Appl. No.: 16/160,219

(22) Filed: Oct. 15, 2018

(65) Prior Publication Data

US 2019/0112153 A1 Apr. 18, 2019

Related U.S. Application Data

(60) Provisional application No. 62/573,529, filed on Oct. 17, 2017.

(51) Int. Cl.
*B66B 5/00* (2006.01)
*A62B 35/00* (2006.01)

(52) U.S. Cl.
CPC ..... *B66B 5/0081* (2013.01); *A62B 35/0068* (2013.01); *B66B 5/0043* (2013.01)

(58) Field of Classification Search
CPC combination set(s) only.
See application file for complete search history.

(56) References Cited

U.S. PATENT DOCUMENTS 495,503 A 4/1893 Martin
643,286 A 2/1900 Feiker
1,275,053 A 8/1918 Leiding
1,392,962 A * 10/1921 Murphy ..... B66B 17/34 248/205.1
1,583,055 A 5/1926 Lane
1,665,991 A 4/1928 Stramaglia
1,977,706 A * 10/1934 Watts ..... B66B 5/027 187/401
2,583,613 A 1/1952 Talbott
3,880,255 A 4/1975 Huntley
4,633,612 A 1/1987 Forkish
5,655,628 A 8/1997 Lin
6,233,877 B1 5/2001 Monroe
6,550,580 B1 4/2003 Roches
6,640,509 B2 * 11/2003 Clewis ..... E06B 9/02 248/200.1
6,976,339 B1 * 12/2005 Riccio ..... E04G 21/1841 248/354.1
7,108,100 B2 9/2006 Stingl
7,634,830 B2 12/2009 Ryan
7,681,361 B1 * 3/2010 Jendusa ..... E04G 23/0218 248/219.4
7,753,334 B2 7/2010 Schreiber
(Continued)

FOREIGN PATENT DOCUMENTS

AU 641007 9/1993
FR 2118199 7/1972
(Continued)

*Primary Examiner* — Monica E Millner

(57) ABSTRACT

An elevator shaft access safety device for an elevator shaft access provided with landing doors extending thereacross, the landing doors being flanked by substantially vertical first and second jambs, the elevator shaft access safety device being securable to the first and second jambs while the landing doors remain closed.

18 Claims, 11 Drawing Sheets

(56) References Cited

U.S. PATENT DOCUMENTS

| | | | | |
|---|---|---|---|---|
| 2005/0224286 | A1 | 10/2005 | Hsun | |
| 2005/0230194 | A1* | 10/2005 | Nakamura | B66B 5/0081 187/401 |
| 2012/0067668 | A1 | 3/2012 | Rico | |

FOREIGN PATENT DOCUMENTS

| | | |
|---|---|---|
| WO | 2000070169 | 11/2000 |
| WO | 2002094700 | 11/2002 |
| WO | 2010056202 | 5/2010 |

* cited by examiner

ELEVATOR SHAFT ACCESS SAFETY DEVICE AND METHOD OF USING THE SAME

FIELD OF THE INVENTION

The present invention relates to the general field of elevators, and is more specifically concerned with an elevator shaft access safety device and a method of using the same.

BACKGROUND

There is sometimes a need to access an elevator shaft through an access located above the elevator shaft floor, for example for maintenance purposes or to rescue people stuck in an elevator. Such accesses are for example in the form of the opening in a wall normally closed by landing doors. Since falling down the elevator shaft could cause major injuries or death, people accessing the elevator shaft need to be secured to a harness that is itself secured to a sturdy structure. For aesthetic and safety reasons, such structures are not typically permanently provided outside of the elevator shaft at all floors in a building. Currently, such structures are temporary structure requiring that the landing doors be opened for installation before the harness can be secured to the structure. Therefore, there is a time window during which the landing doors are opened and during which the personnel adjacent the landing door is not protected from falling by the harness.

Against this background, there exists a need in the construction industry to provide an improved elevator shaft access safety device and a method of using the same. An object of the present invention is therefore to provide such an improved elevator shaft access safety device and a method of using the same.

SUMMARY OF THE INVENTION

In a broad aspect, there is provided an elevator shaft access safety device for an elevator shaft access leading to an elevator shaft, the elevator shaft access being delimited by a casing including substantially vertical first and second side jambs and a head jamb extending therebetween above the elevator shaft access, the casing defining an inner surface facing the elevator shaft, an opposed outer surface, and lateral surfaces at each of the first and second side jambs, the lateral surfaces facing each other across the elevator shaft access, the elevator shaft access being provided with landing doors extending thereacross, the elevator shaft access safety device comprising: a substantially L-shaped body including a body first section and a body second section extending substantially perpendicularly relative to each other, the body first and second sections being substantially elongated, the body defining an abutment, wherein with the elevator shaft access safety device operatively mounted to the casing, the body first and second sections extend respectively along the first side and head jambs and the abutment abuts against outer surface; and a clamp extending substantially perpendicular to both the body first and second sections and secured to the body, the clamp defining a clamping member for engaging the inner surface, the clamp being positioned and operative for biasing the abutment and the clamping member towards each other when the elevator shaft access safety device is operatively mounted to the casing; the body defining an attachment portion for attaching a rope harness thereto; wherein the elevator shaft access safety device is configured and sized to be secured to the casing while the landing doors remain closed.

There may also be provided an elevator shaft access safety device wherein the body first section defines a first section abutment and the body second section defines a second section abutment, wherein, with the elevator shaft access safety device operatively mounted to the casing, the body first and second section abutments abut respectively against the outer surface at the first and second side jambs.

There may also be provided an elevator shaft access safety device wherein, the clamping member is substantially plate-shaped.

There may also be provided an elevator shaft access safety device wherein the clamping member is substantially in register with one of the first and second section abutments.

There may also be provided an elevator shaft access safety device wherein the clamp is removably mounted to the body first section.

There may also be provided an elevator shaft access safety device wherein the clamp is mountable to the body first section at at least two longitudinally spaced apart positions along the clamp.

There may also be provided an elevator shaft access safety device wherein the clamp is telescopic and includes substantially elongated clamp first and second members longitudinally movable relative to each other and an actuator operatively coupled to the clamp first and second members for selectively moving the clamp first and second members relative to each other, the clamp first member being mountable to the body first section and the clamping member being part of the clamp second member and movable relative to the body.

There may also be provided an elevator shaft access safety device wherein the body first section defines a recess in a plate extending generally coplanar with the remainder of the body and the clamp first member defines a slit receiving part of the plate thereinto, wherein the clamp first member is mounted in the recess so as to be longitudinally fixed relative thereto.

There may also be provided an elevator shaft access safety device wherein the body first section includes a first section first member having a substantially L-shaped transversal cross-sectional configuration and defining the first section abutment.

There may also be provided an elevator shaft access safety device wherein the body second section is telescopic and defines the second section abutment longitudinally opposed to the body first section.

There may also be provided an elevator shaft access safety device wherein the body second section is lockable at at least two different lengths.

There may also be provided an elevator shaft access safety device wherein the body second section includes a jamb engaging portion opposed to the body first section for engaging the second side jamb, the jamb engaging portion including an abutment element for abutting against the lateral surface of the second side jamb. There may also be provided an elevator shaft access safety device wherein the body first and second sections are selectively pivotable relative to each other so as to be movable between a retracted configuration, wherein the body first and second sections are substantially parallel to each other, and a deployed configuration, wherein the body first and second sections are substantially perpendicular to each other.

There may also be provided an elevator shaft access safety device wherein the body first section is foldable to reduce an overall length of the body first section.

In another broad aspect, there is provided a method of mounting an elevator shaft access safety device for an elevator shaft access leading to an elevator shaft, the elevator shaft access being delimited by a casing including substantially vertical first and second side jambs, a head jamb extending therebetween above the elevator shaft access, and a floor below the elevator shaft access, the casing defining an inner surface facing the elevator shaft, an opposed outer surface and a pair lateral surfaces at the first and second side jambs facing each other across the elevator shaft access, the elevator shaft access being provided with landing doors extending thereacross, the elevator shaft access safety device including a substantially L-shaped body including a body first section and a body second section extending substantially perpendicularly relative to each other, the body first and second sections being substantially elongated, the body first section defining a first section abutment and the body second section defining a second section abutment; and a clamp extending substantially perpendicular to both the body first and second sections and secured to the body, the clamp defining a clamping member, the body also defining an attachment portion for attaching a rope harness thereto, the method comprising: with the landing doors remaining closed, positioning the body adjacent the casing with the body first and second sections extending respectively along the first side and head jambs; abutting the body first and second section abutments against the outer surface respectively at the first and second side jambs; inserting the clamping member between the inner surface and the landing doors; tightening the clamp to bias the clamping member towards the inner surface and bias the first and second section abutments towards the outer surface; wherein the elevator shaft access safety device is secured to the casing while the landing doors remain closed.

There may also be provided a method further comprising abutting the body first section against the floor.

There may also be provided a method wherein the body second section is telescopic and defines a jamb engaging portion opposed to the body first section, the method further comprising abutting the jamb engaging portion against the lateral surface of the second side jamb and abutting the body first section against the lateral surface of the first side jamb.

In yet another aspect, there is provided an assembly, comprising: an elevator shaft access leading to an elevator shaft, the elevator shaft access being delimited by a casing including substantially vertical first and second side jambs and a head jamb extending therebetween above the elevator shaft access, the casing defining an inner surface facing the elevator shaft, an opposed outer surface and a pair of lateral surfaces at the first and second side jambs facing each other across the elevator shaft access, the elevator shaft access being provided with landing doors extending thereacross; and an elevator shaft access safety device comprising: a substantially L-shaped body including a body first section and a body second section extending substantially perpendicularly relative to each other, the body first and second sections being substantially elongated, the body defining an abutment, the body first and second sections extending respectively along the first side and head jambs and the abutment abutting against the outer surface; and a clamp extending substantially perpendicular to both the body first and second sections and secured to the body, the clamp defining a clamping member inserted between the inner surface and the landing doors and engaging the inner surface, the clamp biasing the abutment and the clamping member towards each other; the body defining an attachment portion for attaching a rope harness thereto; wherein the elevator shaft access safety device is secured to the casing with the landing doors remain closed. In the assembly, any selection and combination of the features of the elevator shaft access safety device mentioned above my be combined.

Advantageously, the proposed elevator shaft access safety device can be secured to the casing before the landing doors are opened to improve safety. In some embodiments, the proposed elevator shaft access safety device is adjustable so as to be usable in many different buildings in which the elevator shaft access has different dimensions and the jambs have different thicknesses. Also, in some embodiments, the proposed elevator shaft access safety device is collapsible so as to be easily handled when carried from one location to another.

The present application claims priority from U.S. provisional patent application 62/573,529 filed Oct. 17, 2017, the contents of which is hereby incorporated by reference in its entirety.

Other objects, advantages and features of the present invention will become more apparent upon reading of the following non-restrictive description of some embodiments thereof, given by way of example only with reference to the accompanying drawings.

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. These variations are to be interpreted from the point of view of the person skilled in the art.

Directional terminology, such as right, left, top, bottom, forward and backward, among others, refers to the orientation relative to an upstanding landing door. This terminology is used for clarity reasons and should not be used to unduly restrict the scope of the claims.

The various features of the proposed elevator shaft access safety device 10 described hereinbelow may be combined together in any suitable manner and in any number.

Figure 1:
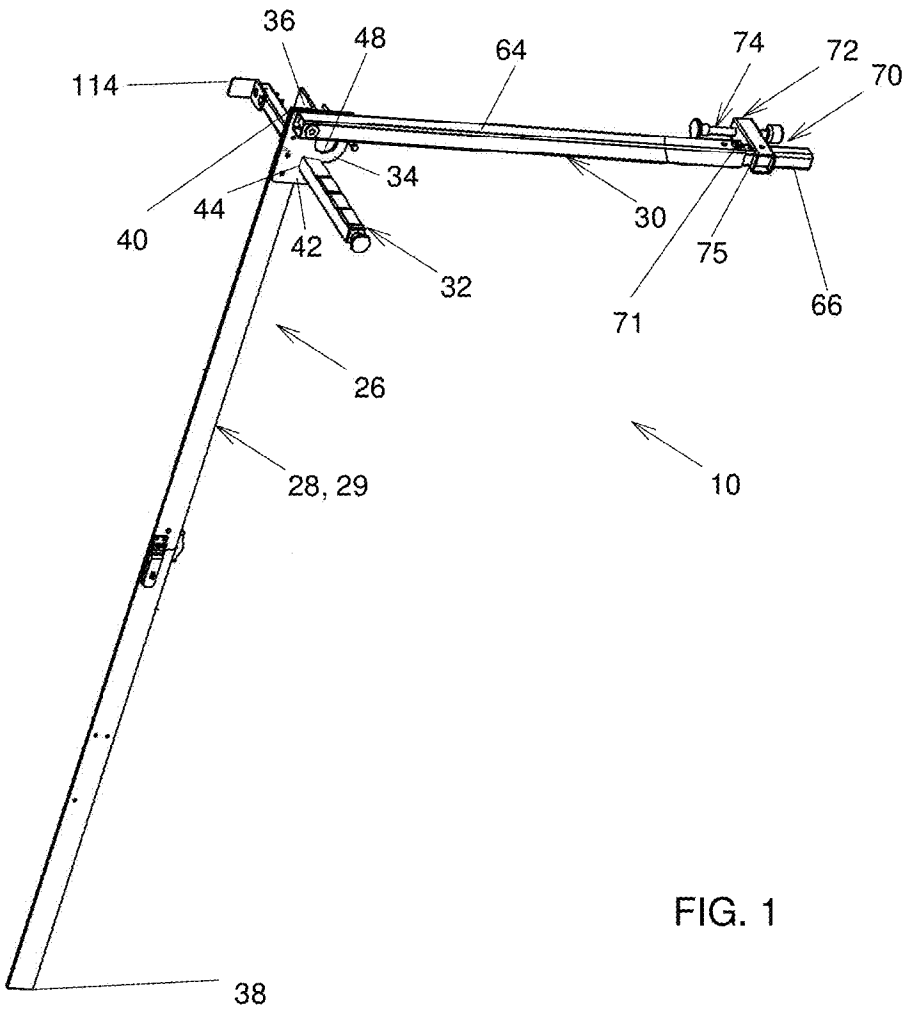
FIG. 1, in a perspective view, illustrates an elevator shaft access safety device according to an embodiment of the present invention.
Figure 18:
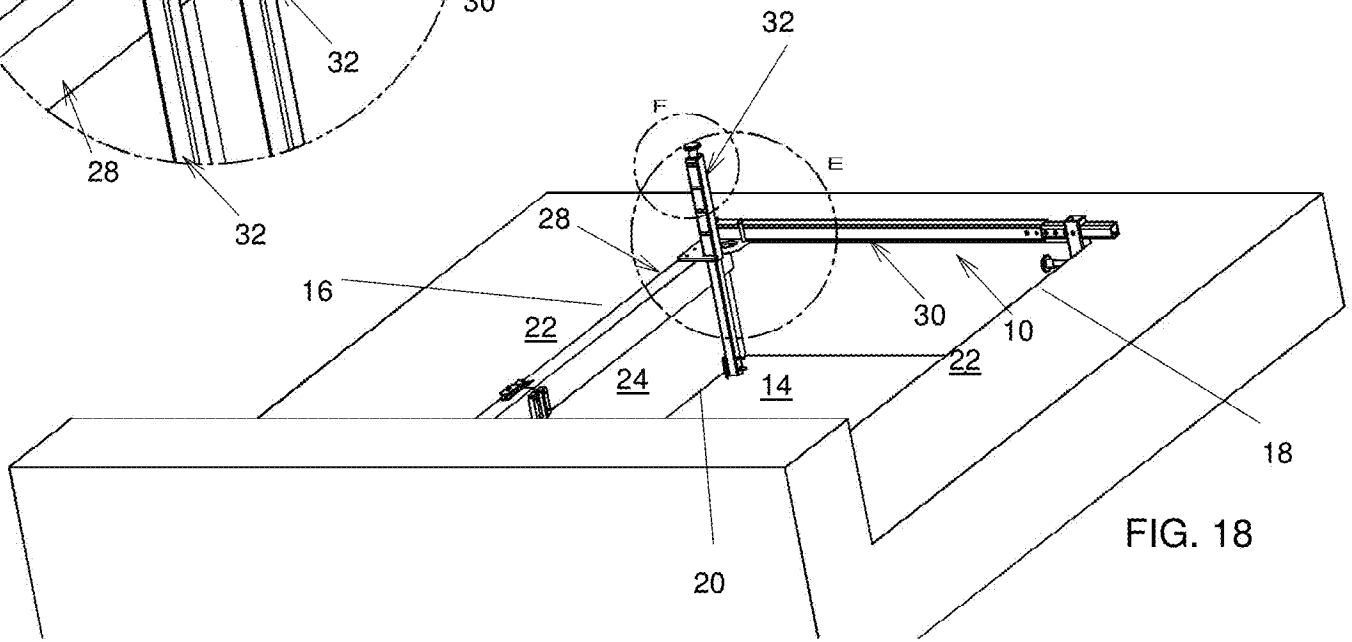
FIG. 18, in a perspective view, illustrates a sixth step in the method of using the elevator shaft access safety device of FIG. 1.

FIG. 1 illustrates an elevator shaft access safety device 10. Referring to FIG. 18, the elevator shaft access safety device 10 is usable to improve safety when accessing an elevator shaft access 12 delimited by a casing 13 and leading to an elevator shaft 11. The elevator shaft access is provided with landing doors 14 extending thereacross. The casing 13 includes substantially vertical first and second side jambs 16 and 18 and a head jamb 19 extending therebetween. The elevator shaft access safety device 10 is securable to the casing 13, for example to the first and second side jambs 16 and 18. The casing 13 defines an inside surface 20, facing the elevator shaft 11, an outside surface 22 opposed to the inside surface 20 and typically substantially parallel thereto, and a pair of lateral surfaces 24 extending therebetween at the first and second side jambs 16 and 18, the lateral surfaces 24 facing each other across the elevator shaft access 14. The landing doors 14 are behind the first and second side jambs 16 and 18 when seen from outside the elevator shaft.

Returning to FIG. 1, the elevator shaft access safety device 10 includes a substantially L-shaped body 26. The body 26 includes a body first section 28 and a body second section 30 extending substantially perpendicularly relative to each other. A clamp 32 extends substantially perpendicular to both the body first and second sections 28 and 30 and is secured to the body 26. The body first and second sections 28 and 30 and the clamp 32 are typically substantially elongated. As seen in FIG. 18, when the elevator shaft access safety device 10 is operatively mounted to the casing 13, the body first and second sections 28 and 30 extend across the elevator shaft access 12 substantially parallel to the landing doors of 14, and abut against the outside surfaces 22. The body first section 28 is substantially parallel to and extend along the first side jamb 16. The body first section 28 is substantially parallel to and extend along the head jamb 19. The clamp 32 extends substantially parallel to the lateral surface 24 of the first side jamb 16 and abuts against the inside surface at the first side jamb 16 so that the elevator shaft access safety device 10 grips the first side jamb 16. An attachment portion 34 is provided for attaching a harness rope (not shown in the drawings) thereto, either directly or through a hook or carabiner, among other possibilities. The elevator shaft access safety device 10 is securable to the casing 13 while the landing doors 14 remain closed.

Figure 13:
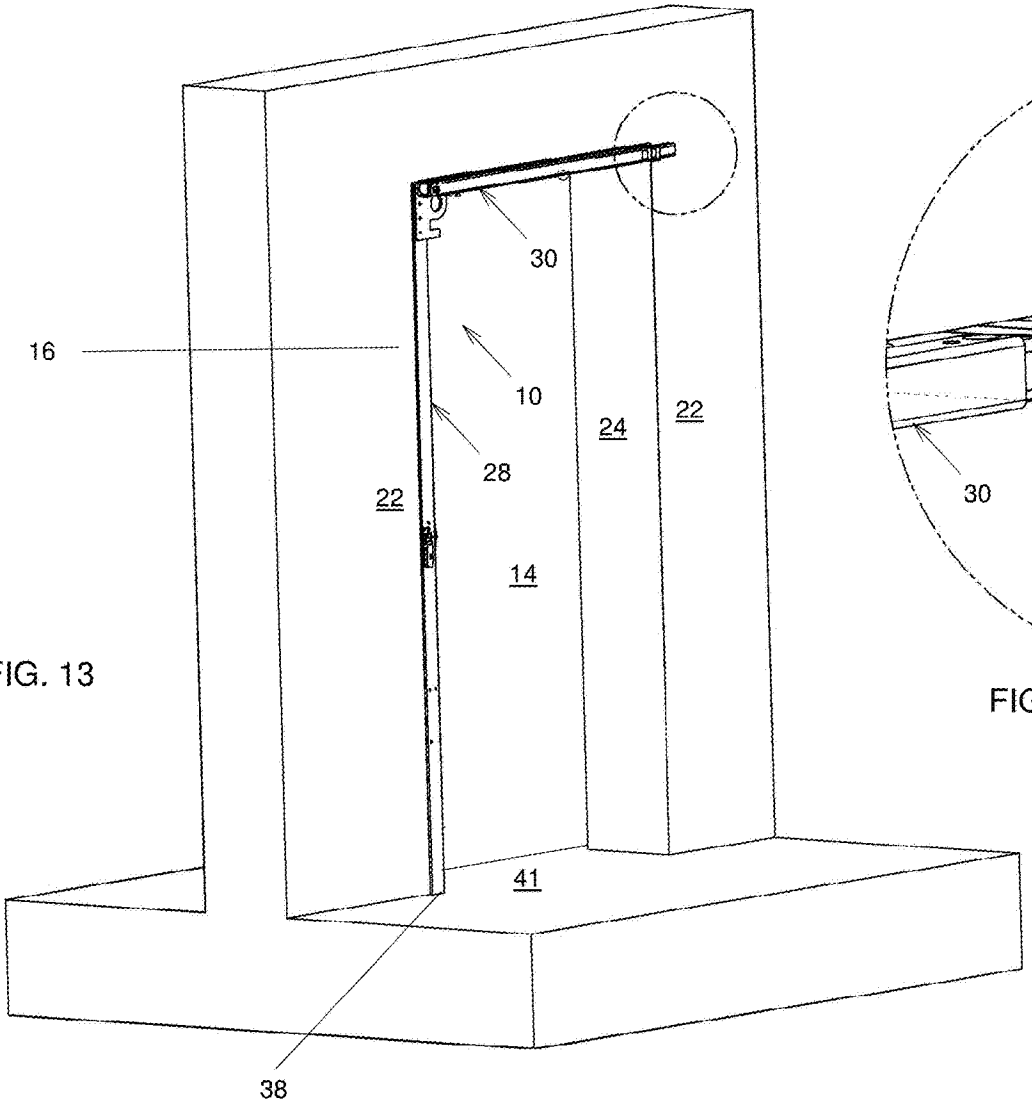
FIG. 13, in a perspective view, illustrates a fourth step in the method of using the elevator shaft access safety device of FIG. 1.

The body first section 28 includes a substantially elongated member 29 having a generally L-shaped transversal cross-sectional configuration. The substantially elongated member 29 defines a recess 36 for receiving thereinto the first side jamb 16. The recess 36 is defined in the concave portion of the L-shaped configuration of the substantially elongated member 29. The substantially elongated member 29 defines a first section abutment 31 for abutting against the outside surface 22. The first section abutment 31 is for example formed in one of the plates defining the elongated member 29. The body first section 28 defines substantially longitudinally opposed first section lower and upper ends 38 and 40. In use, the first section lower end 38 abuts against the floor 41, as seen in FIG. 13 for example.

A coupling portion 42 is provided at the first section upper end 40 and removably receives the clamp 32 so that the latter is removable mountable to the body first section 28. The coupling portion 42, for example, is substantially plate shaped, extending substantially parallel to the plane defined by the body first and second sections 28 and 30, and secured to the substantially elongated member 29. The coupling portion 42 defines a recess 44 extending generally parallel to the body second section 30 and extending laterally inwardly towards the substantially elongated member 29. The recess 44 is for example provided inside the corner defined by the body first and second sections 28 and 30. In some embodiments, the coupling portion 42 and the attachment portion 34 are both formed in the same plate 46 provided at the first section upper end 40. Such a configuration is advantageously safe as the device 10 is then mounted to the casing 13 close to the location where forces are exerted if someone attached to the device 10 falls in the elevator shaft 11. The plate 46 defines an aperture 48 extending therethrough in the attachment portion 34, which allows attachment of a rope, hook or carabiner, among other possibilities, to the elevator shaft access safety device 10.

Figure 10:
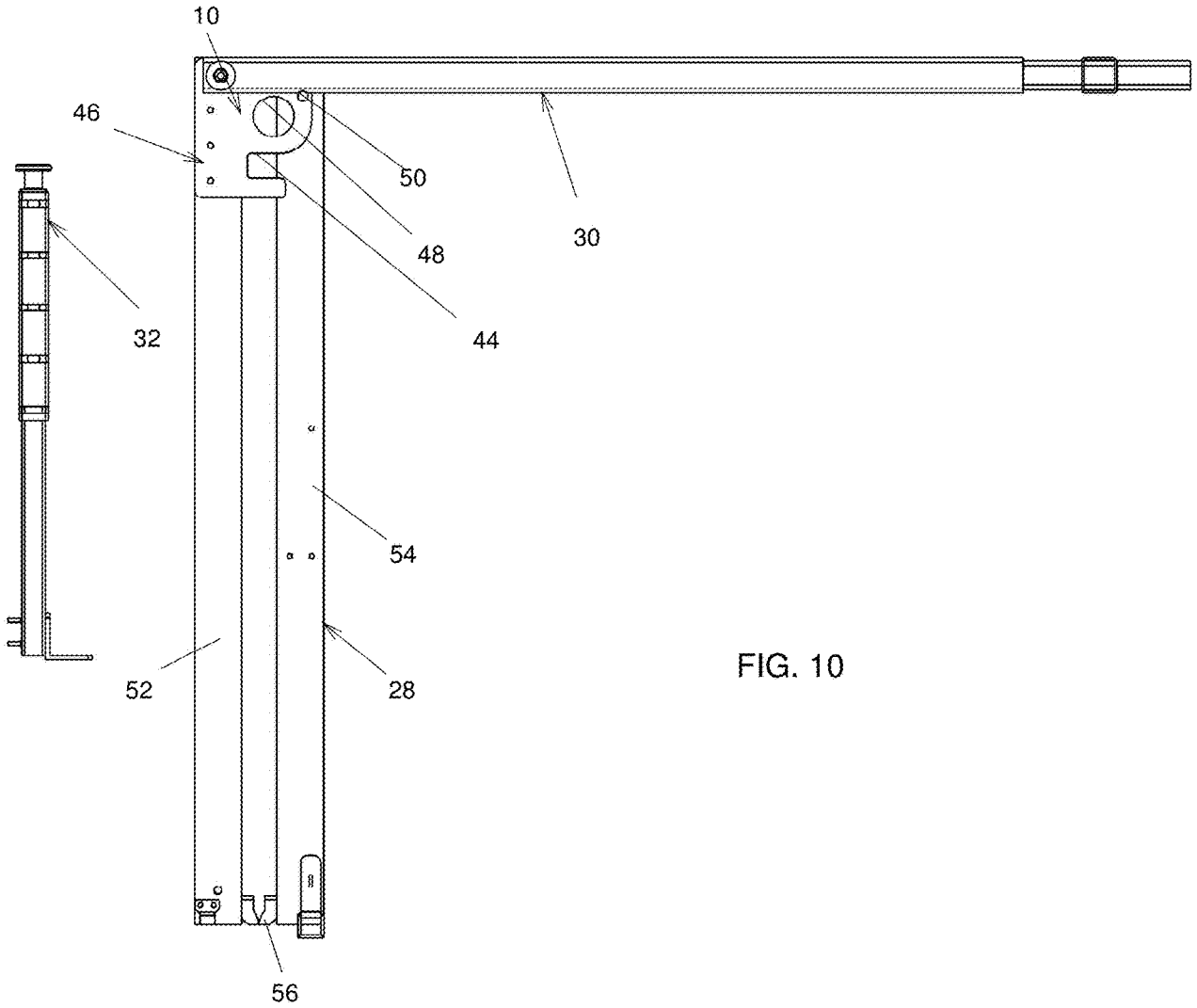
FIG. 10, in a front plan view, illustrates a second step in the method of using the elevator shaft access safety device of FIG. 1.

A pin 50, better seen in FIG. 10 for example, extends from the plate 46, generally perpendicular thereto so that the body second section 30 can abut thereagainst when the body second section 30 is substantially perpendicular to the body first section 28. When the elevator shaft access safety device is operatively mounted to the first and second side jambs 16 and 18, the pin 50 is below the body second section 30.

In some embodiments, the body first section 28 includes first section first and second portions 52 and 54 connected to each other to a hinge 56. In such embodiments, wherein the body first section 28 is thus foldable to reduce an overall length of the body first section 28. The hinge 56 is for example provided approximately midway between the first element lower and upper ends 38 and 40 and allows one to fold the relatively long body first section 28 for storage or transportation purposes. A lock 58 is provided for locking the body first section 28 in an extended configuration in which the first section first and second portions 52 and 54 extend axially from each other. For example, the lock 58 takes the form of a draw latch extending between the first section first and second portions of 52 and 54. When the lock 58 is unlocked, the hinge 56 can rotate to allow folding of the first section first and second portions 52 and 54.

Figure 9:
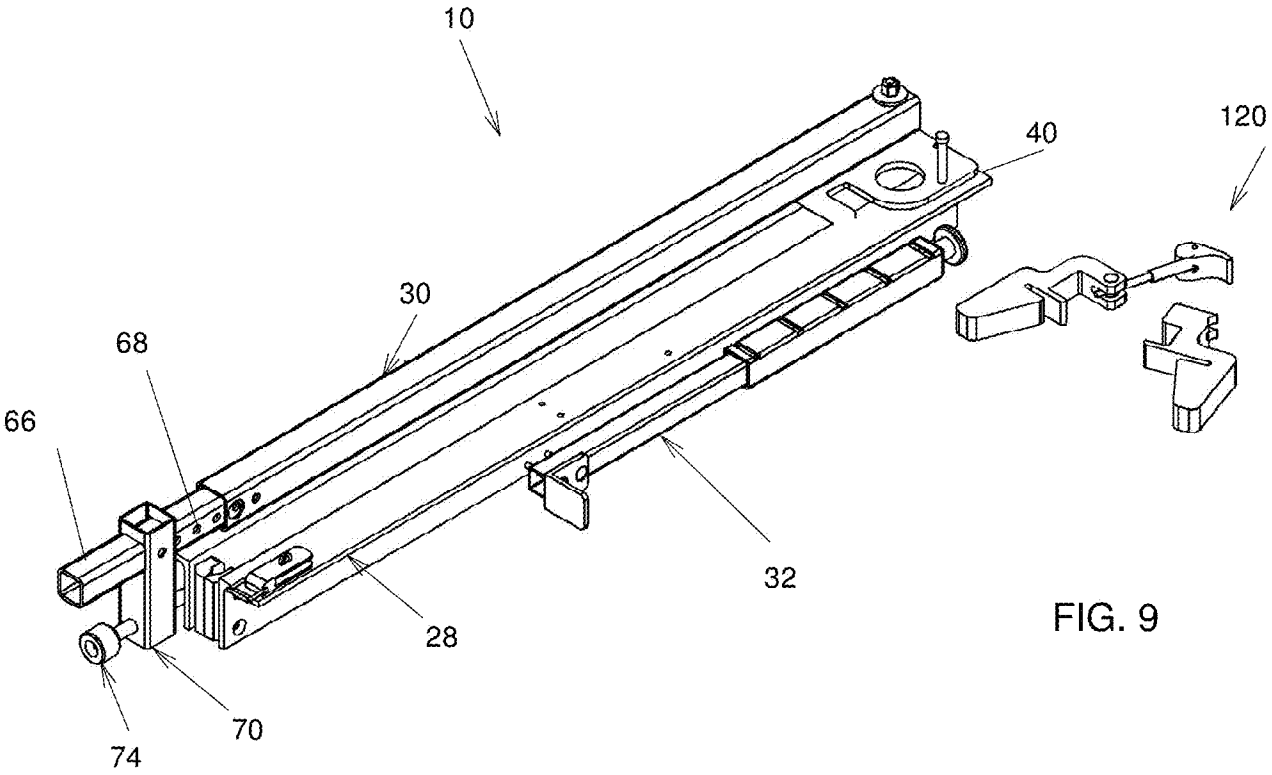
FIG. 9, in a perspective view, illustrates a first step in an exemplary method of using the elevator shaft access safety device of FIG. 1.

Referring for example to FIG. 9, the body second section 30 is telescopic and includes second section first and second members 64 and 66. The second section first member is 64 is pivotally mounted to the body first section 28 at one end thereof, typically at the first section upper end 40. The second section first member is 64 is hollow and slidably receives thereinto, opposed to the body first section 28, the second section second member 66. Locking apertures 68 extends through both the second section first and second members 64 and 66, so that a pin 71 can be inserted through both the second section first and second members 64 and 66 to lock the second section first and second members 64 and 66 relative to each other.

Typically, the second section second member 66 defines a plurality of longitudinal spaced apart locking apertures 68 so that the second section second member 66 may be locked at different insertion depths in the second section first member 64. For example, the second section first and second members 64 and 66 may both have substantially square transversal cross-sectional configurations, but other configurations are within the scope of the invention. The second section second member 66 is typically substantially snugly received in the second section first member 64, but loosely enough to be able to move relative thereto relatively easily.

The body second section 30 also includes a jamb engaging portion 70 opposed to the body first section 28 for engaging the second side jamb 18. The jamb engaging portion 70 is defined by the second section second member 66, which defines an abutment for abutting against the second surface, for example a free end portion thereof, and an adjustable element 72. The adjustable element 72 is mounted to the second section second member 66, opposed to the second section first member 64. To that effect, the adjustable element 72 defines a second member receiving aperture 75 extending therethrough and receiving the second section second member 66 therethrough. A fastener extending between the adjustable element 72 and the second section second member 66 locks these two components in a fixed relative position. Thus, the body second section 30 is lockable at at least two different lengths. The adjustable element 72 includes an abutment element 74 for abutting against the lateral surface 24 of the second side jamb 18. The abutment element 74 and second section second member 66 therefore define together a generally L-shaped recess for receiving the second side jamb 18.

Figure 4:
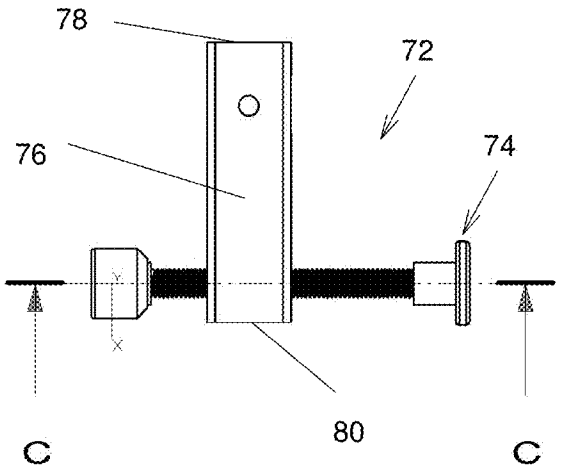
FIG. 4, in a top elevation view, illustrates an adjustable element part of the elevator shaft access safety device of FIG. 1.
Figure 5:
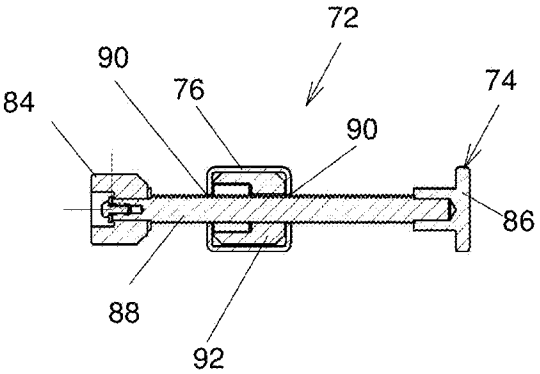
FIG. 5, in a side cross-sectional view along section line C-C of FIG. 4, illustrates the adjustable element of FIG. 4.

The adjustable element 72 is better seen in FIGS. 4 and 5. The adjustable element 72 includes an adjustable element body 76, taking for example the form of a tubular member, and defining opposed adjustable element body first and second ends 78 and 80. The second member receiving aperture 75 extends laterally through the adjustable element body 76. A pair of opposed adjustable element body apertures 82 (only one of which is shown in FIG. 4) are provided in the adjustable element body 76 to receive the fastener fixing the adjustable element body 76 to the second section second member 66.

The abutment element 74 is mounted to the adjustable element body 76 so as to extend generally parallel to the second section second member 66. As seen in FIG. 5, the abutment element 74 includes opposed handle 84 and abutment element end portion 86 and a threaded rod 88 extending therebetween. The threaded rod 88 is mounted through a pair of rod mounting apertures 90 extending through the adjustable element body 76. A threaded sleeve 92 extending coaxially with the rod mounting apertures 90 is provided in the adjustable element body 76 and is threadedly engaged by the threaded rod 88. In alternative embodiments, the threaded rod 88 may threadedly engage one or both rod mounting apertures 90. Thus, the threaded rod 88 may be moved relative to the adjustable element body 76 to vary the position of the abutment element end portion 86.

Figure 2:
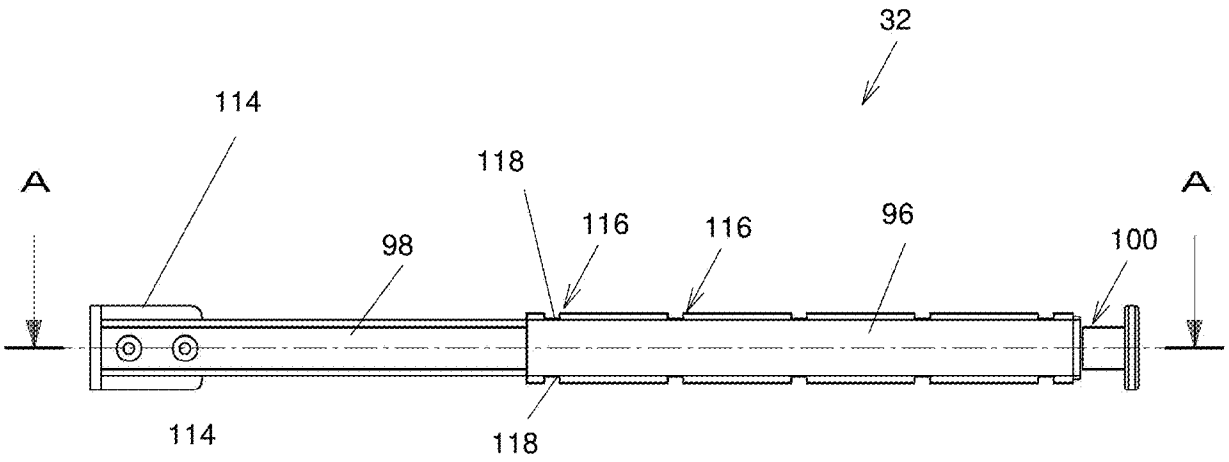
FIG. 2, in a side elevation view, illustrates a clamp part of the elevator shaft access safety device of FIG. 1.
Figure 3:
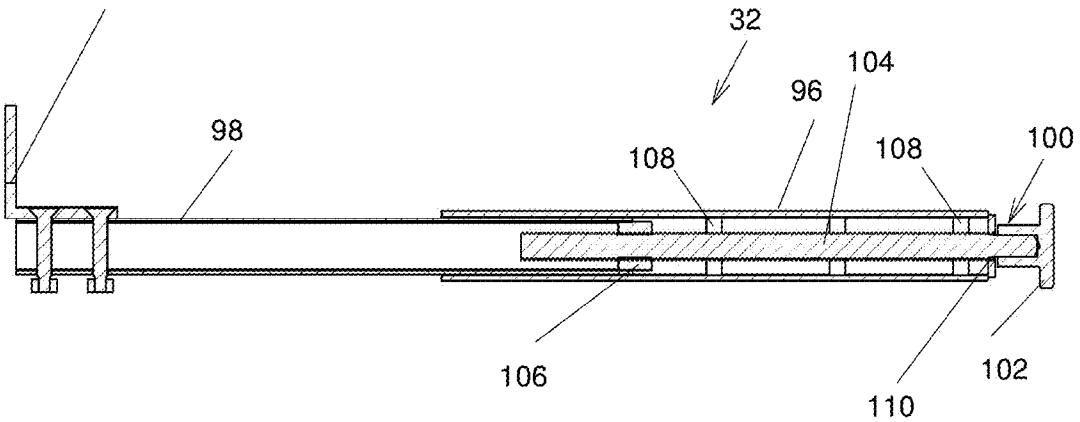
FIG. 3, in a top cross-sectional view along section lines A-A of FIG. 2, illustrates the clamp of FIG. 2.

Referring to FIGS. 2 and 3, the clamp 32 is telescopic and includes substantially elongated clamp first and second members 96 and 98 and an actuator 100 for selectively moving longitudinally the clamp first and second members 96 and 98 relative to each other. For example, the clamp first member 96 is hollow and receives part of the clamp second member 98 thereinto so that the later is movable along the former. The actuator 100 is operatively coupled to the clamp first and second members 96 and 98 to selectively move the clamp first and second members 96 and 98 relative to each other. Referring to FIG. 3, in a specific embodiment, the actuator 100 includes an end knob 102 mounted to a threaded rod 104 extending in the clamp first member 96 and reaching the clamp second member 98. The first element first member 96 is provided at its end opposed the clamp second member 98 with an axial aperture 110 large enough to provide access to the threaded rod 104 but smaller than the diameter of the end knob 102. The clamp second member 98 is also provided with a threaded sleeve 106 opening axially and receiving the threaded rod 104 opposed to the end knob 102. In some embodiments, supporting flanges 108 are provided in the clamp first member 96 for supporting the threaded rod 104 between the end knob 102 and the threaded sleeve 106 while allowing rotation of the threaded rod relative to the clamp first member 96. A clamping member 114 extends from the clamp second member 98 perpendicularly thereto, typically at the end of the clamp second member 98 opposed to the threaded sleeve 106. Therefore, by rotating the end knob 102, an intended user may move the clamping member 114 relative to the clamp first member 96 and bias the end plate 114 towards the end knob 102.

The clamping member 114 is provided for engaging the inner surface 20. The clamp 32 is positioned and operative for biasing the abutment of the body first and second sections 28 and 30 and the clamping member 114 towards each other when the elevator shaft access safety device 19 is operatively mounted to the casing 13. In some embodiments, the clamping member. Advantageously, the clamping member is shaped to be inserted between the inside surface 20 and the landing doors 14. To that effect, the clamping member is relatively thin. For example the clamping member is substantially plate-shaped. The clamping member may take the form of a plate, or of any other relatively thin structure. The clamping member is in some embodiments substantially in register with one of the abutments defined in the body first and second sections 28 and 30.

The clamp 32 is in some embodiments removably mountable to the body first section 28. To the effect, the clamp 32 includes a clamp mount 116. For example, the clamp mount 116 takes the form of a pair of slits 118 formed opposed to each other in the clamp first member 96 and extending generally laterally. The slits 118 are configured and sized for engaging the recess 44. More specifically, the slits 118 receive the plate 46 thereinto so that the clamp 32 is mounted in the recess 44 so as to be longitudinally fixed relative thereto by sliding laterally relative to the plate 46. In some embodiments, the clamp 32 includes more than one clamp mount 116 provided at different longitudinally spaced apart location along the clamp first member 96 so that the clamp 32 is mountable to the body first section 28 at at least two longitudinally spaced apart positions along the clamp 32. Thus, the clamp first member 96 is mountable to the body first section 28 and the clamping member 114, part of the clamp second member 98, is movable relative to the body 26. When the clamp 32 is operatively mounted to the body first section 28, the end plate 114 faces the substantially elongated member 29 of the body first section 28.

Figure 7:
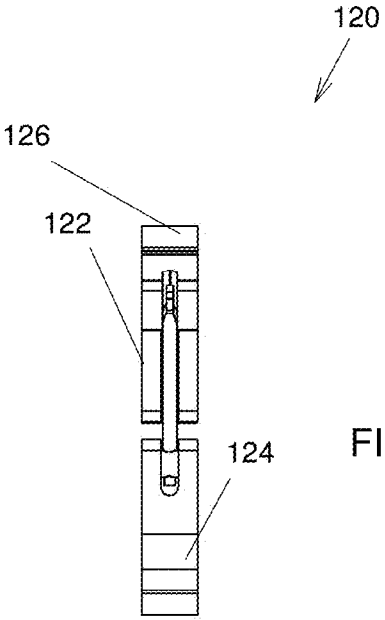
FIG. 7, in a top plan view, illustrates the clip of FIG. 6.
Figure 6:
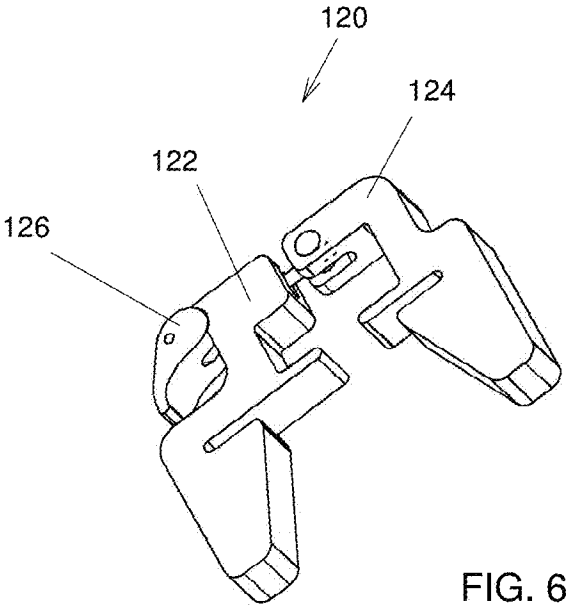
FIG. 6, in a perspective view, illustrates a clip usable with the elevator shaft access safety device of FIG. 1.

FIGS. 6 and 7 illustrate a clip 120 usable in some embodiments of the invention. The clip 120 is usable to secure to each other the various components of the elevator shaft access safety device 10 in embodiments in which the latter is collapsible to a compact configuration. For example, the clip 120 includes clip first and second members 122 and 124 and a lock 126 usable for locking the clips first and second members 122 and 124 to each other. The clip first and second members 122 and 124 are configured and sized for receiving the body first and second sections 28 and 30 and the clamp 32 therebetween when the lock 126 is locked. The lock 126 may be for example of the cam lever type in which a rod provided with a lever at one end thereof is secured through the rod, opposed to the lever, to one of the clip first and second members 122 and 124, while the lever is provided with a cam that abuts against a suitably shaped portion of the other one of the clip first and second members 122 and 124 to bias the clip first and second members 122 and 124 towards each other. However, other types of lock 126 are within the scope of the present invention.

Figure 8:
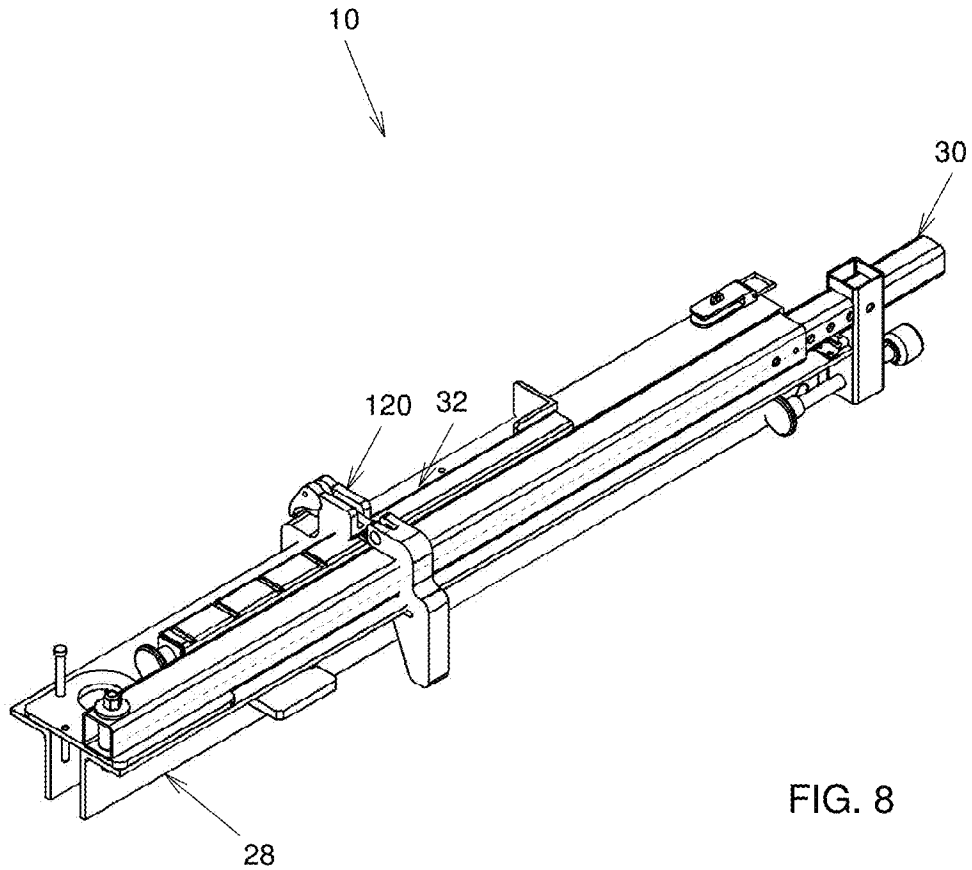
FIG. 8, in a perspective view, illustrates the elevator shaft access safety device of FIG. 1 in a collapsed configuration with the clip securing the various components of the elevator shaft access safety device of FIG. 1 to each other.

FIGS. 8 to 18 illustrate an example of a sequence of steps that may be performed to use the elevator shaft access safety device 10. First, as seen in FIG. 8, the elevator shaft access safety device 10 is collapsed. To the effect, the body first section 28 is folded in half over itself at the hinge 56 in a retracted configuration and the body second section 30 is rotated so as to be parallel and in register with the body first section 28. The clamp 32 is detached from the body first section 28 and positioned parallel thereto. The body first and second sections 28 and 30 and the clamp 32 are locked to each other by the clip 120.

Then, as seen in FIG. 9, the clip 120 is unlocked and removed. This allows removing the clamp 32 away from the body 26. Subsequently, as seen in FIG. 10, the body second section 30 can be rotated relative to the body first section 28 until it extends perpendicular to the latter in a deployed configuration. For example, the body second section 30 is rotated until it abuts against to pin 50, the latter being positioned so as to be below the former when the elevator shaft access safety device 10 is later installed upstanding.

Figures 11, 12:
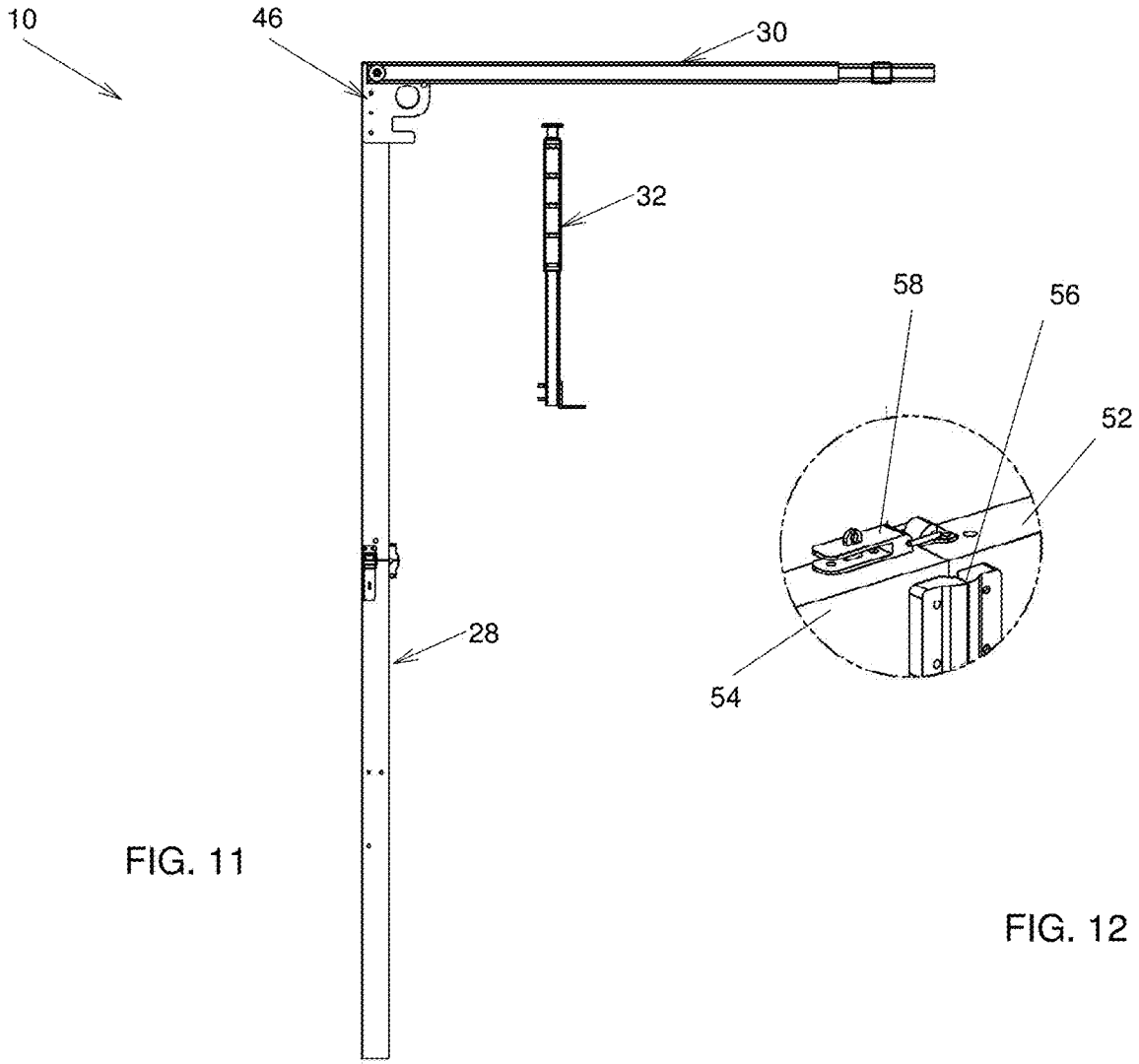
FIG. 11, in a front plan view, illustrates a third step in the method of using the elevator shaft access safety device of FIG. 1.
FIG. 12, in a perspective view, illustrates a lock part of the elevator shaft access safety device of FIG. 1.
Figure 14:
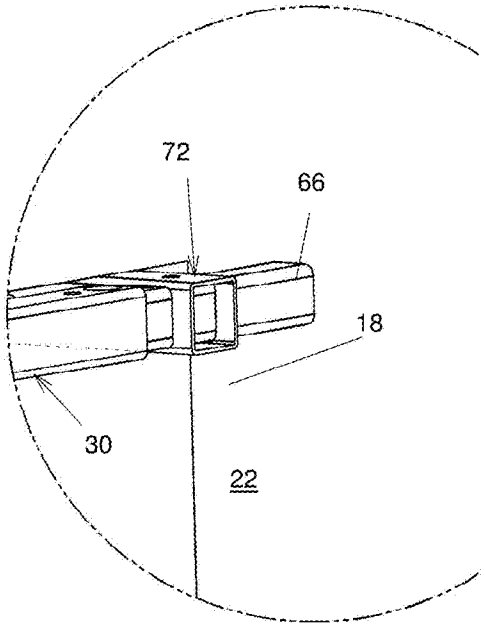
FIG. 14, in a perspective partial view, illustrates mounting of the elevator shaft access safety device of FIG. 1 to a second side jamb.

In a next step, as seen in FIG. 11, the body first section 28 is extended at the hinge 56 and locked using the lock 58, as seen in FIG. 12, so that the first element first and second sections 52 and 54 extend axially from each other and are maintained in this configuration.

Figure 15:
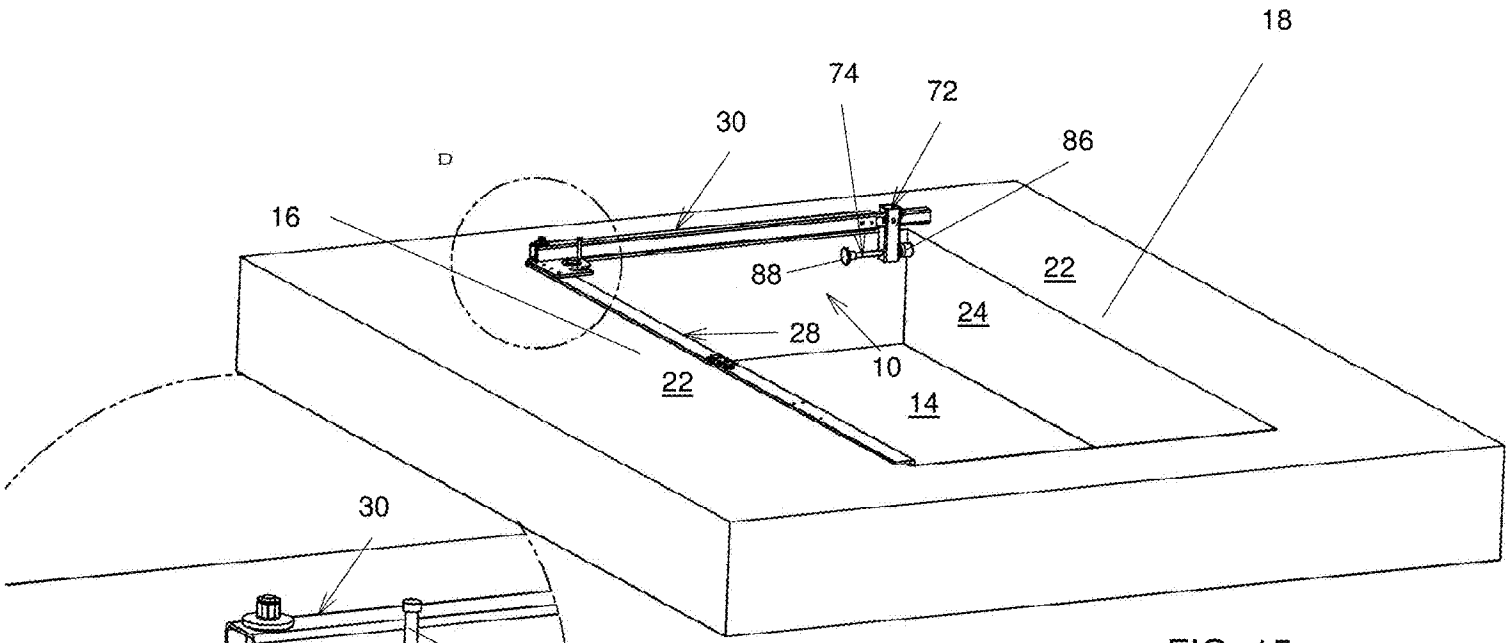
FIG. 15, in a perspective view, illustrates a fifth step in the method of using the elevator shaft access safety device of FIG. 1.
Figure 16:
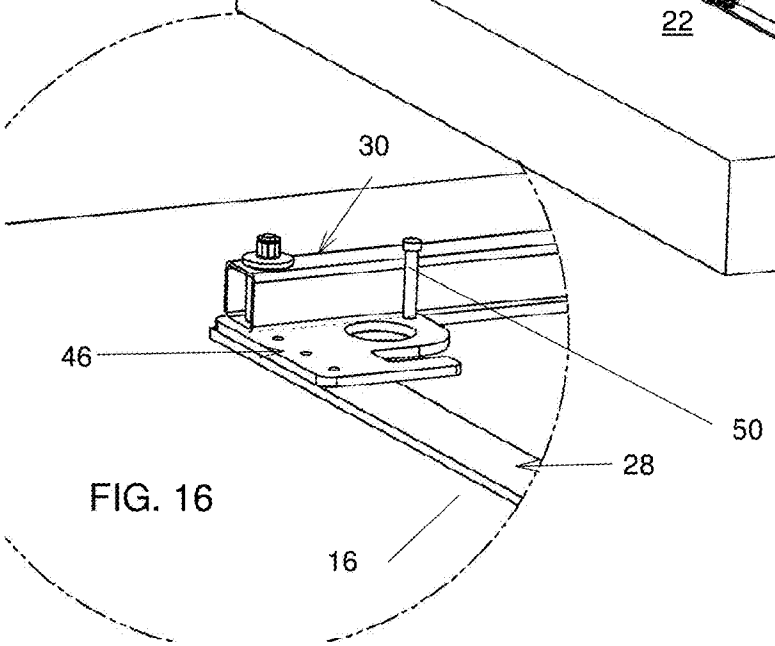
FIG. 16, in a perspective partial view, illustrates mounting of the elevator shaft access safety device of FIG. 1 to a first side jamb.

A seen in FIG. 13, the elevator shaft access safety device 10 is then positioned to engage the first and second side jambs 16 and 18. To that effect, the first side jamb 16 is inserted in the recess 36 at the junction between its lateral and outside surfaces 24 and 22 and the body first section 28 extends parallel to the first side jamb 16 and abuts against the floor 41. The body second section 30 extends towards the second side jamb 18 and abut against its outside surface 22. To that effect, the second element second member 66 is slid relative to the second element first member 64 until the second element second member 66 can abut against the outside surface 22 of the second side jamb 18 and the pin 71 is used to secure the second element first and second members 64 and 66 at this location. In this configuration, the elevator shaft access safety device 10 cannot be pushed through the opening between the first and second side jambs 16 and 18. Then, as seen in FIG. 15, the handle 84 is turned until the abutment element end portion 86 firmly abuts against the lateral surface 24.

Figure 17:
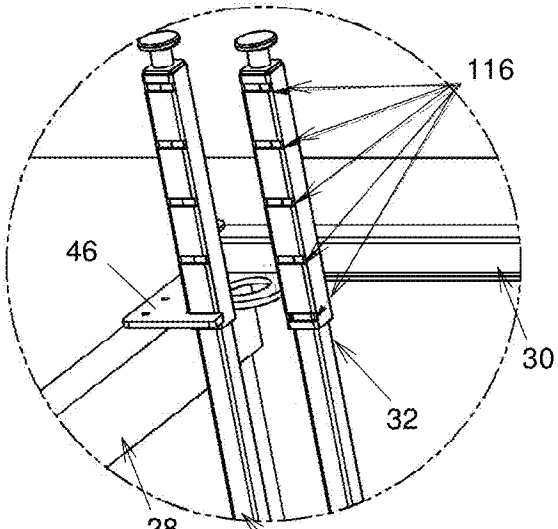
FIG. 17, in a perspective partial view, illustrates assembly of a body and a clamp part of the elevator shaft access safety device of FIG. 1.

As seen in FIG. 17, the clamp 32 is then inserted in the recess 44 at a suitable clamp mount 116. The clamp mount 116 is selected to that by turning the end knob 102, the end plate 114 can be inserted between the inside surface 20 and the landing doors 14. After insertion, the end knob 102 is further tightened to fully secure the elevator shaft access safety device 10 between the first and second side jambs 16 and 18 by biasing the body first section 28 and the clamping member 114 towards each other. The elevator shaft access safety device 10 can now be used to attach a harness and the landing doors 14 can be opened.

Removal and storage of the elevator shaft access safety device 10 proceed by reversing these steps.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. An elevator shaft access safety device for an elevator shaft access leading to an elevator shaft, the elevator shaft access being delimited by a casing including substantially vertical first and second side jambs and a head jamb extending therebetween above the elevator shaft access, the casing defining an inner surface facing the elevator shaft, an opposed outer surface, and lateral surfaces at each of the first and second side jambs, the lateral surfaces facing each other across the elevator shaft access, the elevator shaft access being provided with landing doors extending thereacross, the elevator shaft access safety device comprising:

a substantially L-shaped body including a body first section and a body second section extending substantially perpendicularly relative to each other, the body first and second sections being substantially elongated, the body defining an abutment, wherein with the elevator shaft access safety device operatively mounted to the casing, the body first and second sections extend respectively along the first side and head jambs and the abutment abuts against outer surface; and a clamp extending substantially perpendicular to both the body first and second sections and secured to the body, the clamp defining a clamping member for engaging the inner surface, the clamp being positioned and operative for biasing the abutment and the clamping member towards each other when the elevator shaft access safety device is operatively mounted to the casing;

the body defining an attachment portion for attaching a rope harness thereto;

wherein the elevator shaft access safety device is configured and sized to be secured to the casing while the landing doors remain closed.

2. The elevator shaft access safety device as defined in claim 1, wherein the body first section defines a first section abutment and the body second section defines a second section abutment, wherein, with the elevator shaft access safety device operatively mounted to the casing, the body first and second section abutments abut respectively against the outer surface at the first and second side jambs.

3. The elevator shaft access safety device as defined in claim 2, wherein, the clamping member is substantially plate-shaped.

4. The elevator shaft access safety device as defined in claim 2, wherein, the clamping member is substantially in register with one of the first and second section abutments.

5. The elevator shaft access safety device as defined in claim 2, wherein the clamp is removably mounted to the body first section.

6. The elevator shaft access safety device as defined in claim 5, wherein the clamp is mountable to the body first section at at least two longitudinally spaced apart positions along the clamp.

7. The elevator shaft access safety device as defined in claim 5, wherein the clamp is telescopic and includes substantially elongated clamp first and second members longitudinally movable relative to each other and an actuator operatively coupled to the clamp first and second members for selectively moving the clamp first and second members relative to each other, the clamp first member being mountable to the body first section and the clamping member being part of the clamp second member and movable relative to the body.

8. The elevator shaft access safety device as defined in claim 7, wherein the body first section defines a recess in a plate extending generally coplanar with the remainder of the body and the clamp first member defines a slit receiving part of the plate thereinto, wherein the clamp first member is mounted in the recess so as to be longitudinally fixed relative thereto.

9. The elevator shaft access safety device as defined in claim 2, wherein the body first section includes a first section first member having a substantially L-shaped transversal cross-sectional configuration and defining the first section abutment.

10. The elevator shaft access safety device as defined in claim 2, wherein the body second section is telescopic and defines the second section abutment longitudinally opposed to the body first section.

11. The elevator shaft access safety device as defined in claim 2, wherein the body second section is lockable at at least two different lengths.

12. The elevator shaft access safety device as defined in claim 10, wherein the body second section includes a jamb engaging portion opposed to the body first section for engaging the second side jamb, the jamb engaging portion including an abutment element for abutting against the lateral surface of the second side jamb.

13. The elevator shaft access safety device as defined in claim 1, wherein the body first and second sections are selectively pivotable relative to each other so as to be movable between a retracted configuration, wherein the body first and second sections are substantially parallel to each other, and a deployed configuration, wherein the body first and second sections are substantially perpendicular to each other.

14. The elevator shaft access safety device as defined in claim 1, wherein the body first section is foldable to reduce an overall length of the body first section.

15. A method of mounting an elevator shaft access safety device at an elevator shaft access leading to an elevator shaft, the elevator shaft access being delimited by a casing including substantially vertical first and second side jambs, a head jamb extending therebetween above the elevator shaft access, and a floor below the elevator shaft access, the casing defining an inner surface facing the elevator shaft, an opposed outer surface and a pair lateral surfaces at the first and second side jambs facing each other across the elevator shaft access, the elevator shaft access being provided with landing doors extending thereacross, the elevator shaft access safety device including a substantially L-shaped body including a body first section and a body second section extending substantially perpendicularly relative to each other, the body first and second sections being substantially elongated, the body first section defining a first section abutment and the body second section defining a second section abutment; and a clamp extending substantially perpendicular to both the body first and second sections and secured to the body, the clamp defining a clamping member, the body also defining an attachment portion for attaching a rope harness thereto, the method comprising:

with the landing doors remaining closed, positioning the body adjacent to the casing with the body first and second sections extending respectively along the first side and head jambs;

abutting the body first and second section abutments against the outer surface respectively at the first and second side jambs;

inserting the clamping member between the inner surface and the landing doors; and tightening the clamp to bias the clamping member towards the inner surface and bias the first and second section abutments towards the outer surface;

wherein the elevator shaft access safety device is secured to the casing while the landing doors remain closed.

16. The method as defined in claim 15, further comprising abutting the body first section against the floor.

17. The method as defined in claim 15, wherein the body second section is telescopic and defines a jamb engaging portion opposed to the body first section, the method further comprising abutting the jamb engaging portion against the lateral surface of the second side jamb and abutting the body first section against the lateral surface of the first side jamb.

18. An assembly, comprising:

an elevator shaft access leading to an elevator shaft, the elevator shaft access being delimited by a casing including substantially vertical first and second side jambs and a head jamb extending therebetween above the elevator shaft access, the casing defining an inner surface facing the elevator shaft, an opposed outer surface and a pair of lateral surfaces at the first and second side jambs facing each other across the elevator shaft access, the elevator shaft access being provided with landing doors extending thereacross; and an elevator shaft access safety device comprising:

a substantially L-shaped body including a body first section and a body second section extending substantially perpendicularly relative to each other, the body first and second sections being substantially elongated, the body defining an abutment, the body first and second sections extending respectively along the first side and head jambs and the abutment abutting against the outer surface; and a clamp extending substantially perpendicular to both the body first and second sections and secured to the body, the clamp defining a clamping member inserted between the inner surface and the landing doors and engaging the inner surface, the clamp biasing the abutment and the clamping member towards each other;

the body defining an attachment portion for attaching a rope harness thereto;

wherein the elevator shaft access safety device is secured to the casing with the landing doors remain closed.

* * * * *